United States Patent [19]

Forzieri

[11] Patent Number: 4,772,766

[45] Date of Patent: Sep. 20, 1988

[54] PUSH BUTTON DEVICE FOR ELECTRIC CONTACTS OR THE LIKE, PARTICULARLY SUITABLE FOR INSTRUMENTATION PANELS

[75] Inventor: Graziano Forzieri, S. Casciano Val di Pesa, Italy

[73] Assignee: Sirio Panel S.N.C. di Forzieri G. & S., Val di Pesa, Italy

[21] Appl. No.: 863,010

[22] Filed: May 14, 1986

[30] Foreign Application Priority Data

Mar. 10, 1986 [IT] Italy ..... 47747 A/86

[51] Int. Cl.[4] ..... H01H 13/02; H01H 15/02; H01H 1/16

[52] U.S. Cl. ..... 200/16 A; 200/5 R; 200/159 R; 200/277

[58] Field of Search ..... 200/5 R, 5 A, 16 A, 200/16 B, 16 C, 16 D, 159 R, 276, 277, 314, 340, 67 AA, 157, 61.45 R, 155 A

[56] References Cited

U.S. PATENT DOCUMENTS

| | | | |
|---|---|---|---|
| 2,418,616 | 4/1947 | Batcheller | 200/277 X |
| 3,206,561 | 9/1965 | Fordeck | 200/276 |
| 3,681,547 | 8/1972 | Burch et al. | 200/277 X |
| 3,732,387 | 5/1973 | Berry | 200/276 X |
| 4,088,855 | 5/1978 | Emery | 200/276 X |

FOREIGN PATENT DOCUMENTS

| | | | |
|---|---|---|---|
| 2437637 | 2/1975 | Fed. Rep. of Germany | 200/277 |

*Primary Examiner*—J. R. Scott
*Attorney, Agent, or Firm*—John J. Byrne

[57] ABSTRACT

A push button device for electric contacts or the like, particularly suitable for instrumentation panels, that includes a fixed annular body having a movable body external thereof. Two small cylinder-shaped members of conductive material, which in their rest position, are between the fixed body and the movable body and in their contact operative position, are adjacent to the base of the annular body. The device also includes return springs connected to the respective ends of the cylinder-shaped conductive members.

6 Claims, 4 Drawing Sheets

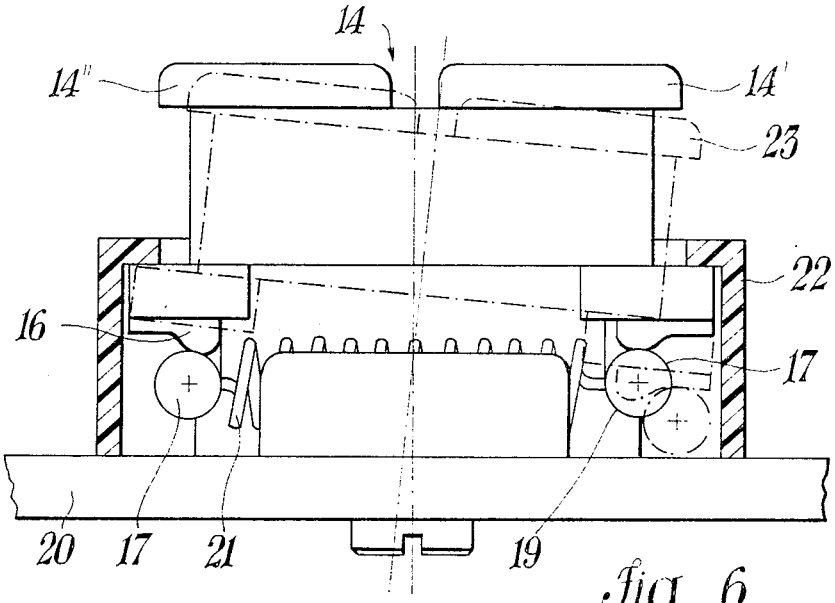
Fig. 6
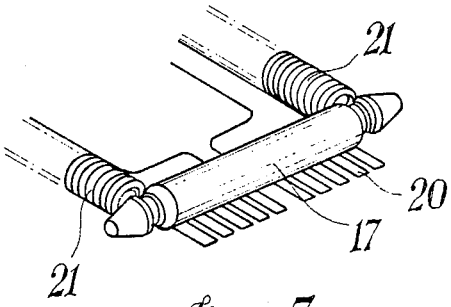
Fig. 7
Fig. 8
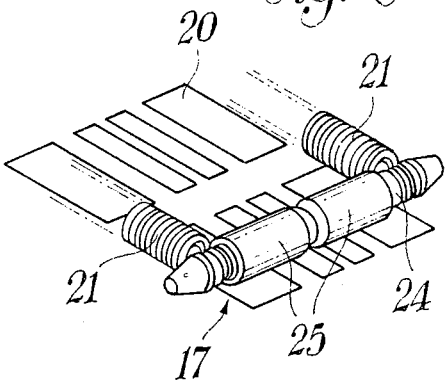
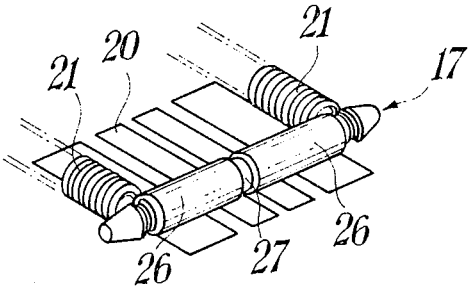
Fig. 9

PUSH BUTTON DEVICE FOR ELECTRIC CONTACT OR THE LIKE, PARTICULARLY SUITABLE FOR INSTRUMENTATION PANELS

BACKGROUND OF THE INVENTION

The present invention relates to a push button device for electric contacts or the like, particularly suitable for instrumentation panels.

More particularly, the present invention relates to a device of the kind mentioned above, which device controls a system of springs and small cylinders through the axial movement of a push button, said springs and cylinders, by moving in turn axially, realizing the contact with an electric or a printed circuit.

A number of solutions have been proposed and realized in the technical field in which the devices of the type the present invention deals with are employed, but said solutions, though sufficiently reliable for the desired uses, give rise to a series of drawbacks that make it difficult to employ the same.

More particularly, the push button device MARK 21 of JAY-EL PRODUCTS, INC. is characterized by the lack of tactile sensation on the user's part.

Such a drawback has been overcome by the device of SYMBOLIC DISPAYS, INC., which are realized employing a synthetic material bulb. Such type of solution shows a tendency to frequent breakage so that it cannot be considered reliable.

Another kind of solution adopted makes use of a contact bearing a printed circuit realized direct on said contact, on a very small area of the same, so that a very large deterioration of the contact points occurs. Moreover, in the case of such solution the tactile sensation is completely lacking.

One of the most advanced systems known (U.S. Pat. No. 4,088,855 for Korry Manufacturing Company) in the technical field makes use of an an annular spring which, by moving axially and laterally under the pressure of a button, realizes the contact. In that way, though the user has the tactile sensation of pushing the button, the danger of device failure if the spring breaks is not completely eliminated, and, in addition, as said spring is in direct contact with the printed circuit, even though on a larger area, it tends to wear said circuit, so that the risk of device failure increases.

SUMMARY

The push button device according to the present invention proposes to obviate these and other drawbacks, said device allowing a safe employment also in the case of breaking of one of said components of the contact mechanism, through a contact mechanism consisting of a number of components, and in addition supplying the operator with a sharp tactile sensation of the push button tripping when it is pressed. Moreover, because of the presence of an elastic reed of conductive material, interposed between said components of the contact mechanism and the printed circuit, the wearing is also advantageously avoided of said printed circuit, with a consequent increase in the factor of safety.

An object of the present invention is that of providing a push button device whose contact members are self-cleaning.

It is a further object of the present invention that of providing a device bearing a push button which is able to realize the contact, on one or more circuits indifferently, said circuits being arranged respectively on the sides of the slider, as a result of a particular configuration of a rocking arm.

It is a further object of the present invention that of providing a push button device which, in its various kinds of embodiment, is provided with contacts which are able to close indifferently a single contact or a multiple-throw contact, two or four independent contacts or two contacts which are independent of one another.

Such features make thus the device according to the present invention suitable for the employment in a number of different instrumentation types, including the aeronautical instrumentation which requires a very high efficiency and a very high factor of safety of each device.

Accordingly, it is a specific object of the present invention to provide a push button device for electric contacts or the like, particularly suitable for instrumentation panels, said device being characterized in that it comprises a fixed shaped annular body, an axially movable body external to said fixed body; small cylinder-shaped means made up of a conductive material, which are intermediate, in the rest position, between said fixed body and said movable body, and, in the contact operative position, are adjacent to the base of said shaped body; elastic conductive reed means provided between said small cylinder-shaped means an the printed circuit; and at least a return elastic spring means connected to the ends of said small cylinder-shaped means.

According to a preferred embodiment of the device according to the present invention, two elastic return spring means are provided, which are connected to the ends of said small cylinder-shaped means.

Again according to a preferred embodiment of the present invention, said elastic conductive reed means consist, at the points corresponding to the area of contact with said small cylinder-shaped means, of portions at a slope with respect to the plane of the printed circuit, said portions being oriented towards said small cylinder-shaped means so as to allow an elastic electric contact with said printed circuit to be realized.

Moreover, again according to the present invention, guiding means can be provided for said spring means on one or on both the sides perpendicular to the position of said small cylinder-shaped means.

Moreover, according to a further embodiment of the present invention, the upper part of said axially movable body external to said fixed body is made up of a light transparent material, so that at least one illuminating means can be provided inside said device.

Advantageously, said electric reed means interposed between said small cylinder-shaped means and a printed circuit protect said circuit from wear. Further according to the present invention, the tactile sensation given by the tripping of said push button device can be sensed by the operator when said small cylinder means go in their axial motion beyond the step-shaped part of said fixed annular body.

Moreover, it is a specific object of the present invention that of providing a push button device for electric contacts or the like, particularly suitable for instrumentation panels, comprising a fixed shaped annular body; a movable body external to said fixed body; two small cylinder-shaped means made up of a conductive material, which, in the rest position, are intermediate between said fixed body and said movable body and, in the contact operative position, are adjacent to the base of said shaped body; and at least an elastic return spring connected to the ends of said small cylinder-shaped means; said fixed shaped annular body bearing at its lower part a concave beveled step and said movable body having a shaped annular striking zone; in correspondence to each of said small cylinder-shaped means, said zone projecting downwards and having beveled edges both inside, towards said fixed body, and outside, said movable body acting, through said annular striking zone, in cooperation with said step, on said small cylinder-shaped means so as to cause the same to rotate and to translate horizontally.

Further again according to the present invention, a stop device can be provided for stopping the stroke of said movable body so as to have the possibility of assembling the push button according to the present invention with a single operation without the need for further supporting systems.

In addition, reed means made up of a conductive material can be provided at a position between said small cylinder-shaped means and the printed circuit.

According to a particularly preferred solution embodying the push button device according to the present invention, said movable body is able to perform rocking motions with respect to said fixed body, around the central axis of the push button, so as to have the possibility of providing alternately one contact each time.

Again according to the present invention, said small cylinder-shaped means can be made up of one only member consisting of a conductive material, said member being capable of realizing the electric contact on a single-throw or on multiple-throw simultaneously, or said small cylinder-shaped means can be made up of two conductive members provided over a core consisting of an insulating material, so that said spring means do not cause said two small cylinder-shaped means to go into contact, and so that each one of the same can thus close at least two separate contacts.

Moreover, said small cylinder-shaped means can also consist of a core made up of an insulating material on which two separate conductive members are provided, but in contact with said spring.

Preferably, said insulating material is made up of an indeformable insulating resin.

BRIEF DESCRIPTION OF THE DRAWINGS

The present invention will be described in the following according to specific embodiments of the same with reference to the enclosed drawings wherein:

FIG. 6 is a side view of a third embodiment with parts in section;

FIG. 7 is a perspective view of a first embodiment of the small cylinder-shaped members;

FIG. 8 is a perspective view of a second embodiment of the small cylinder-shaped members; and FIG. 9 is a perspective view of a third embodiment of the small cylinder-shaped means.

DETAILED DESCRIPTION OF THE DRAWINGS

More particularly, numeral 1 indicates an axially movable body which is external to a fixed body 2. A closure member 3 is made of a light transparent material and is the upper part of the device according to the present invention, and it is suitable for being assembled to said device through the interengaging abutment means or fixing system pointed out as 4.

Figure 1:
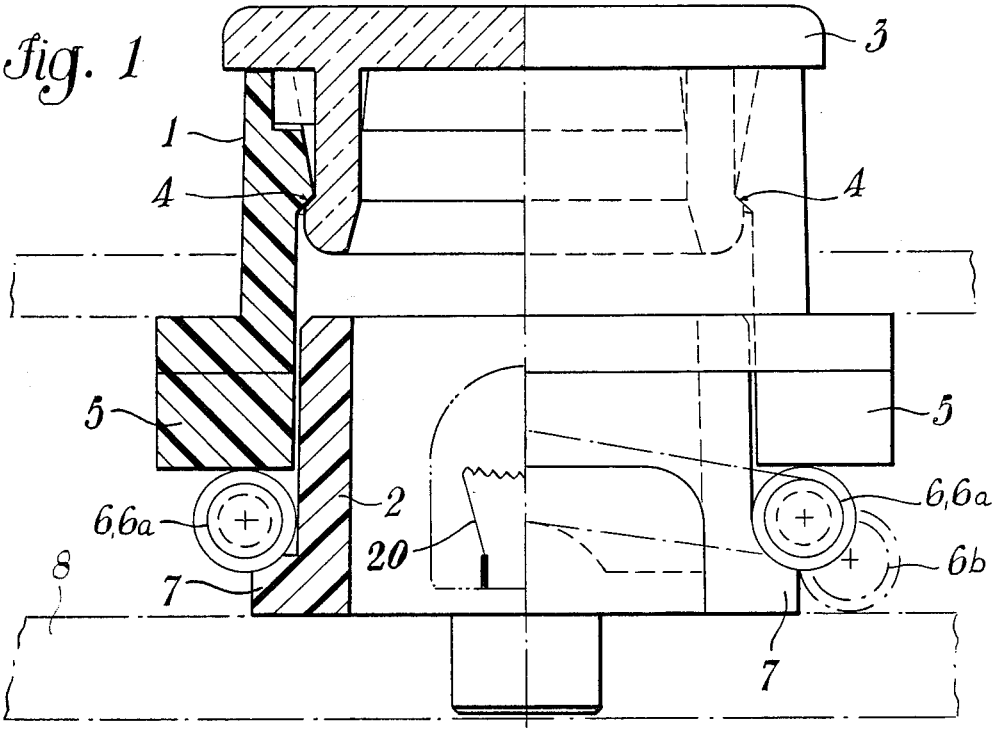
FIG. 1 is a cross section side view of the device according to the present invention, excluding certain reed means which are not shown in order to illustrate operation.
Figure 2:
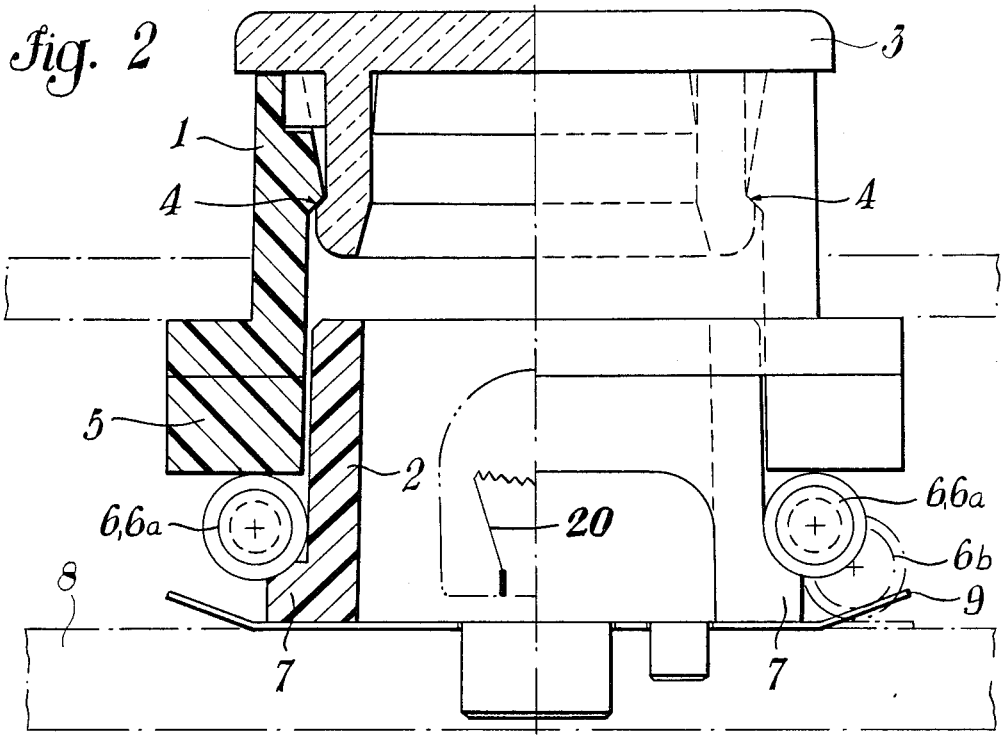
FIG. 2 is another cross section side view.
Figure 3:
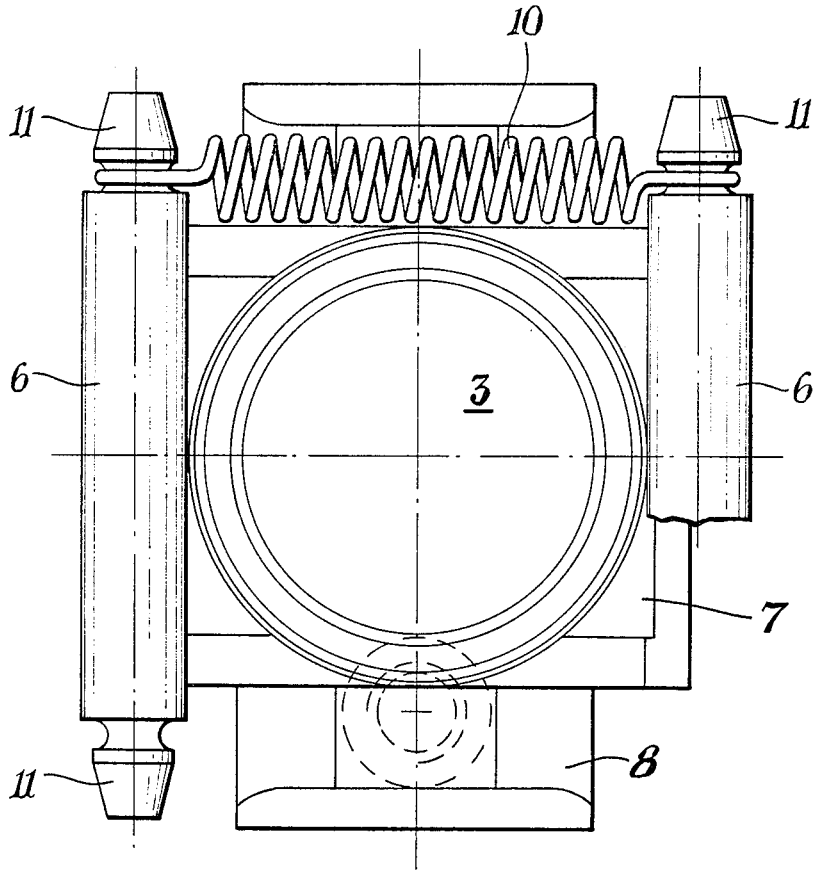
FIG. 3 is a top cutaway view of the device illustrated in FIGS. 1 and 2.

By exerting a downward pressure on member 3, the body 1 is caused to move axially. The movement of member 3 causes axial and lateral shift of the two small cylinders 6 which are manufactured of a conductive material. Cylinders 6 move from an initial "rest" position as shown at **6*a* to a final position 6*b* in which the cylinders 6, after passing the abutment 7 of member 2, realize an electric contact with a printed circuit board 8 by means of the elastic reed 9 (shown in FIG. 2). Each of the reeds 9 is positioned between cylinders 6 and the printed circuit board 8. As soon as the pressure on the member 3 is released, the springs 10 connected to one or to both of the ends 11 of each of said small cylinders 6, as shown in FIG. 3, reset the device to its starting configuration by returning the cylinders 6 to the position 6*a* as a result of their elastic return force of springs 10**.

Figure 4:
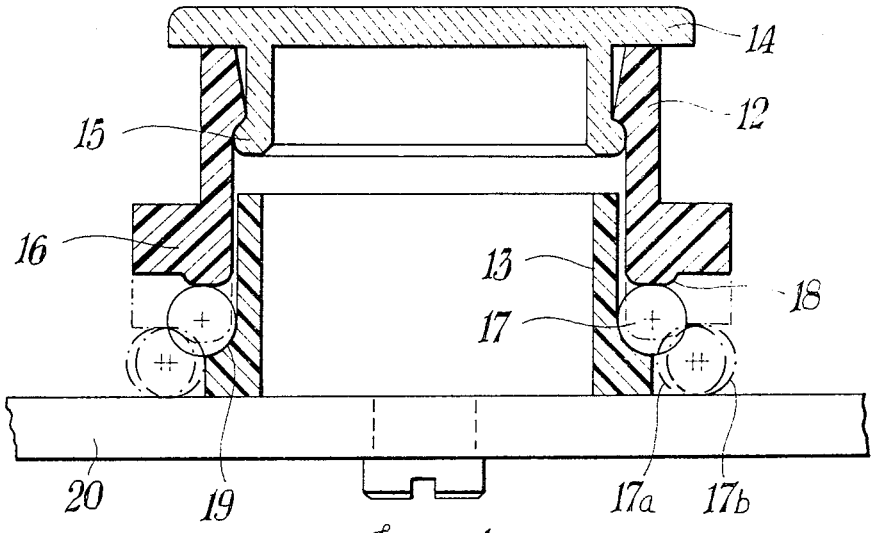
FIG. 4 is a cross section side view variation.

A slidable body 12 of the push button of FIG. 4 moves in the axial direction with respect to a fixed body 13. The closing member 14 consisting of a transparent material is assembled with body 12 by means of interengaging abutment means comprising a fixing system 15, at the upper part of said body 12. An illumination means 20 is attached to the panel 8 within housing 20.

The slidable body 12, at its lower part, presents an annular striking zone 16 of a suitable shape. Indeed, at a point corresponding to the interference zone with said small cylinders 17, said annular zone presents a projecting part 18 with beveled edges both inside, i.e., towards the fixed body 13, and outside.

The cooperation of the projecting part 18 with the beveling of the step 19 of the fixed body 13 results, when the pressure is exerted on the closing member 14, in a rotation caused in said small cylinders 17 about their axes until they reach position **17*b* from 17*a* as seen in FIG. 4**.

Such motions of said small cylinders 17 make them self-cleaning, so that the device according to the present invention is given a higher reliability and operation warranty.

Indeed, it is well known that even a few particles of dust can cause a poor reliability of the contact between the small cylinders 17 and the printed circuit 20.

Figure 5:
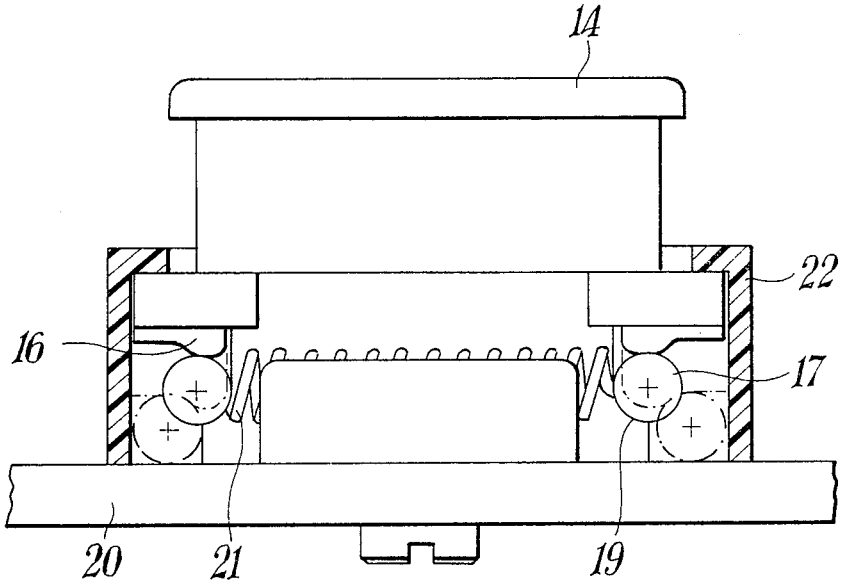
FIG. 5 is a side view of a second embodiment with parts in section.

The two small cylinders 17 are connected at their ends by the springs 21 (see FIG. 5).

A number of reeds made up of a conductive material (not shown) can be provided between said small cylinders 17 and the printed circuit 20.

The embodiment illustrated in FIG. 5 provides a special guide 22 that can be locked on the fixed body 13 of the push button according to the present invention so as to allow the same to be employed in a single assembling operation with no need for guiding the same by means of further supports.

A push button according to the present invention is also shown in FIG. 6. This button has the closing member 14 divided into two half-members 14' and 14''. The assembly consisting of said member 14 and of a sliding member 16 is provided so as to be able to rock in a bascule-like way with respect to the central axis, so that it can close alternately the contact with one of the two small cylinders or with the other one.

The position 23 of the member 14 for closing the right contact of the bush button according to the present invention is shown in the same Figure.

FIG. 7 shows the small cylinder 17 constructed of a single metal piece that can connect one or more electric contacts simultaneously on the printed circuit 20.

According to the embodiment shown in FIG. 8, the small cylinder 17 employs an insulating material core 24, for example a core made up of an indeformable resin, on which two small cylinders 25 consisting of a conductive material are mounted.

Thus, said two insulating material small cylinders 17 are insulated with respect to each other as said cores 24 are in contact with the springs 21, so that it is possible to act with a single switch on two or four electric contacts which are independent of one another and have a single or a separate common member.

A further embodiment of the present invention is shown in FIG. 9, in which embodiment said small cylinder 17 consists of two parts 26 made up of a conductive material arranged around an indeformable insulating resin core 27. Such an arrangement gives the possibility of breaking two contacts which are independent of each other, and have a single or separate common member, as said springs 21 join two by two said conductive members 26 of the small cylinders 17.

The present invention has been disclosed with particular reference to some specific embodiments of the same, but it is to be understood that modifications and changes can be introduced in the embodiment by those who are skilled in the art without departing from the spirit and scope of the invention for which a priority right is claimed.

I claim:

1. An electro-mechanical switch of a type for use with an instrumentation conductor panel having a plurality of spaced contacts on its upper surface, comprising:

a first housing fixed to said panel adjacent said contacts;

a ledge extending outwardly from the lower end of said first housing in the direction of said contacts;

a second annular housing surrounding said first housing and having a lower end in opposed, spaced relationship with said ledge and defining a space therebetween;

a first conductive cylindrical member having a first position in said space and a second position electrically spanning at least two of said contacts;

a second cylindrical member, parallel to said first cylindrical member, having a first position in said space, and a second position electrically spanning at least two other of said contacts;

first means for moving said cylindrical members from said spaces to said second positions; and spring means biasing said cylindrical members to their respective first positions.

2. The switch in claim 1 wherein said first and second cylindrical members are parallel to one another.

3. The switch of claim 2 wherein said spring means are coil springs connected to the ends of said first and second cylindrical members.

4. The switch of claim 3 wherein a transparent cover is secured to the upper end of said second housing and illumination means are secured to said panel with said first housing.

5. The switch of claim 4 wherein said spaced contacts comprise thin reed members having upwardly turned ends adjacent said first and second cylindrical members.

6. The switch of claim 1 wherein said first and second cylindrical members have spaced conductive areas and insulating means between said areas.

* * * * *